US009196152B2

(12) United States Patent
Jordan et al.

(10) Patent No.: US 9,196,152 B2
(45) Date of Patent: Nov. 24, 2015

(54) SYSTEM, METHOD, AND SOFTWARE FOR LOCATION ASSISTED MAPPING AND PATIENT MONITORING

(71) Applicant: Covidien LP, Mansfield, MA (US)

(72) Inventors: William A. Jordan, Westminister, CO (US); Robert T. Boyer, Longmont, CO (US)

(73) Assignee: COVIDIEN LP, Mansfield, MA (US)

( * ) Notice: Subject to any disclaimer, the term of this patent is extended or adjusted under 35 U.S.C. 154(b) by 124 days.

(21) Appl. No.: 13/918,056

(22) Filed: Jun. 14, 2013

(65) Prior Publication Data

US 2014/0368335 A1 Dec. 18, 2014

(51) Int. Cl.
*G08B 1/08* (2006.01)
*G08B 25/01* (2006.01)

(52) U.S. Cl.
CPC ..... *G08B 25/016* (2013.01)

(58) Field of Classification Search
CPC ... G06F 19/323; G06F 13/00; G08B 21/0492; G01S 17/06; G08C 17/02
USPC ..... 340/539.13, 539.12, 539.2, 13.24; 705/2, 3; 600/300
See application file for complete search history.

(56) References Cited

U.S. PATENT DOCUMENTS

| | | | | |
|---|---|---|---|---|
| 6,924,741 | B2 | 8/2005 | Tamayama et al. | |
| 8,405,503 | B2 * | 3/2013 | Wong | 340/539.13 |
| 2011/0106559 | A1 * | 5/2011 | Eaton et al. | 705/3 |
| 2012/0239425 | A1 | 9/2012 | Barber-Mingo et al. | |
| 2012/0313775 | A1 * | 12/2012 | Davis | 340/539.12 |
| 2013/0183924 | A1 * | 7/2013 | Saigh et al. | 455/404.2 |
| 2013/0325508 | A1 * | 12/2013 | Johnson et al. | 705/3 |

* cited by examiner

*Primary Examiner* — Phung Nguyen
(74) *Attorney, Agent, or Firm* — Carter, DeLuca, Farrell & Schmidt, LLP

(57) ABSTRACT

A system and method for location-based healthcare facility management including the steps of generating a map of the healthcare facility, receiving ongoing location data of a remote device positioned within the healthcare facility, receiving ongoing patient data associated with patients being monitored in the healthcare facility, and delivering a notification to the remote device based on the location data of the remote device at a particular time. The remote devices may be notified of alarming conditions and may be notified with the best route to use for arriving to the alarming condition. The remote devices may be updated with patient data and regional data associated with the regions in which they are located and patients located nearby.

20 Claims, 11 Drawing Sheets

SYSTEM, METHOD, AND SOFTWARE FOR LOCATION ASSISTED MAPPING AND PATIENT MONITORING

TECHNICAL FIELD

The present disclosure relates generally to mapping an area using location data, and more particularly to a system, method, and software for mapping a hospital or other structure and monitoring movement within the mapped hospital or structure.

BACKGROUND

Maps are commonly used as useful tools for navigating areas. Currently, people can use pre-made maps in a hardcopy form to navigate an area and pre-made blueprints of a structure to navigate structures such as a building. Using the information printed on the map, a user can plan on how to travel from one point to another. Additionally, the pre-made maps can include information relating to particular regions or zones of the mapped area.

SUMMARY

Aspects of the present disclosure are directed to a system, method, and computer readable recording medium capable of building a map of an area and marking particular points on the map using location data of one or more remote devices.

By receiving location and movement data of remote devices associated with clinicians and patients, the system can more efficiently update patient data and monitor patients. For example, the system can know the physical locations of all of the patients and clinicians within a hospital at all times. If a patient is experiencing an alarming condition, the system can notify the closest clinician(s) of the alarming condition, and provide the clinician(s) with the best route to take to get to the alarming patient, so that a clinician can treat the patient as quickly as possible. Further, with the geographical location of the clinicians and patients available, the system can continuously deliver patient data to the clinician's mobile device as soon as the clinician enters the vicinity of a patient. Additionally, regions can be marked as contaminated if a patient has been diagnosed with a transmittable disease. In particular, by tracking overall patient and clinician flow throughout a hospital, the system can identify which clinicians had contact with a diseased patient and the system can understand, manage, and minimize potential disease transmission within the hospital.

Certain embodiments of the present disclosure may include some, all, or none of the above advantages. One or more other technical advantages may be readily apparent to those skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

The present disclosure incorporates the use of location data and/or movement data to build a map of an area and/or refine a map of an area, such as a hospital building or healthcare facility. The term healthcare facility as used herein, may include a home, hospital building, nursing home, senior facility, senior community, assisted living community, clinic, etc. However, one of skill in the art will recognize that the systems and methods detailed herein may be employed in any building or structure that may be mapped and monitored. After creating or storing a map for an area, location data and movement data of patients and clinicians can be used to assist in monitoring patients and clinicians in a hospital setting. It is desirable to monitor the location data of clinicians and patients in a hospital setting to more efficiently monitor the patients and clinicians.

Figure 1:
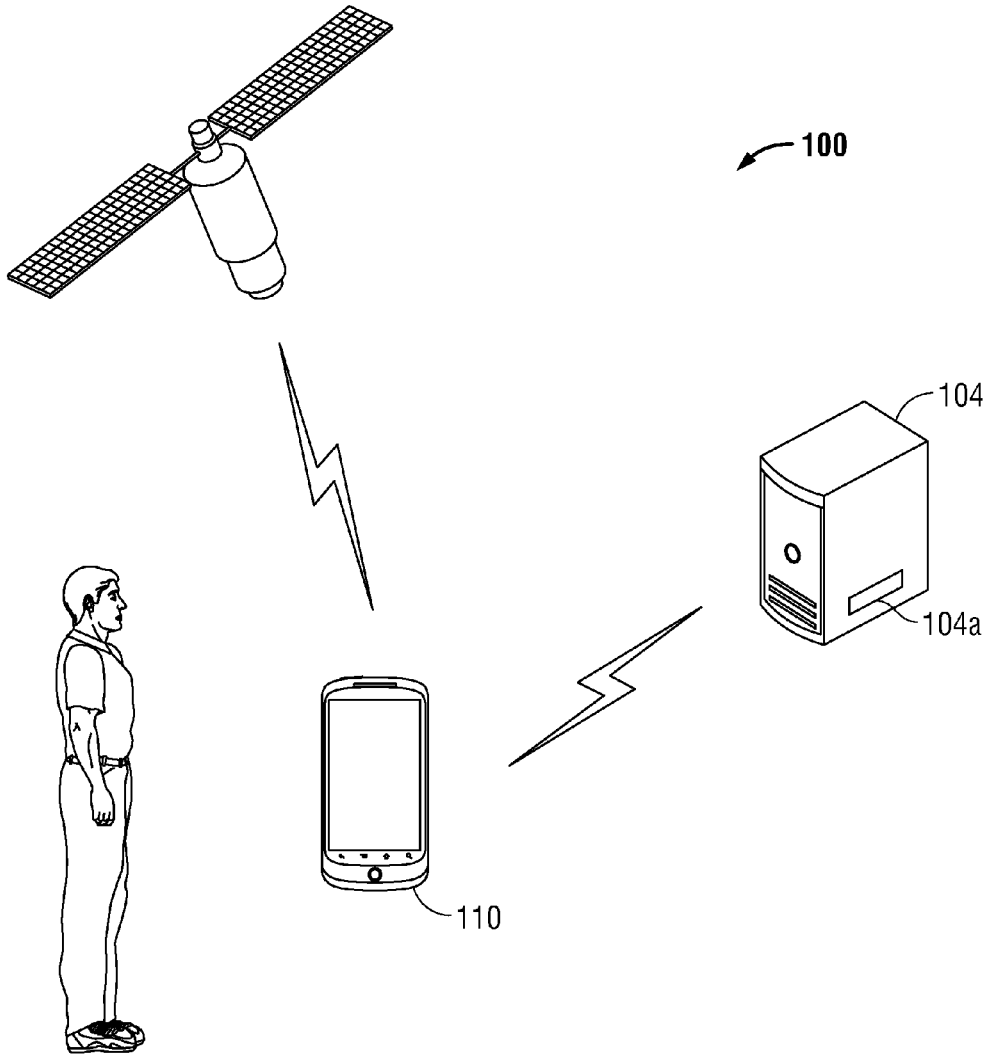
FIG. 1 illustrates an example system for location assisted mapping, according to certain embodiments of the present disclosure.

FIG. 1 illustrates an example system 100 for location assisted mapping and monitoring, according to certain embodiments of the present disclosure. System 100 includes one or more remote devices 110 that are communicatively coupled to one or more data collection servers 104 and one or more location units 107. Although this particular implementation of system 100 is illustrated and primarily described, the present disclosure contemplates any suitable implementation of system 100 according to particular needs of the institution or facility.

Remote devices 110 are communicatively coupled to location unit 107. Location unit 107 may be any device capable of being used in conjunction with the remote devices 110 to determine the location of the remote devices 110. In particular, one or more location units 107 transmit signals to the remote device 110 which enables the remote device 110 and/or data collection server 104 to calculate the location or position of the remote device 110 at a given point in time. The change in location data over a given period of time is characterized herein as movement data. In some embodiments, system 100 includes multiple location units 107 that are used in conjunction with a remote device 110 to determine the location of the remote device 110 via triangulation as is known in the art. In other embodiments, system 100 may include a combination of different types of location units 107. For example, system 100 may utilize GPS satellites, RFID, NFC, Wifi, and cellular signals to determine the location of each of the mobile devices 110.

According to the present disclosure, some or all of the clinicians and patients in a hospital carry a remote device 110, such that their respective position and movement data is calculated and monitored. The position and movement data is collected and stored on the data collection server 104 and can be used for a variety of purposes. For example, the position and movement data can be used for the creation of and/or refinement of maps of the hospital of a facility, to alert a nearest clinician to the occurrence of an alarm condition of a patient and provide the fastest or shortest route to the patient, or the identification of all personnel who may have come in contact with a patient having a communicable disease requiring quarantine. These and other uses of the position movement data are detailed below.

Data collection server 104 includes one or more electronic computing devices operable to receive, transmit, process, and store data associated with system 100, in particular, the location data and movement data of the remote devices 110. Data collection server 104 uses any suitable operating system, as would be understood by those of skill in the art. Although a single data collection server 104 is illustrated, the present disclosure contemplates system 100 including any suitable number of data collection servers 104. Moreover, although referred to as a data collection server, the present disclosure contemplates data collection server 104 comprising any suitable type of processing device or devices.

Data collection server 104 includes a database 104*a* which stores all data received from the mobile devices 110. In particular, database 104*a* stores data corresponding to mapping boundaries defined by a remote device 110, maps that were built by the remote devices 110, maps that are built and uploaded by third-parties, and continuous location data and movement data of the remote devices 110. Data collection server 104 is configured to process the location data and movement data of the remote device(s) 110, using software, to build and store one or more maps of an area such as a hospital building, and/or refine a map that is already stored in database 104*a*. In particular, in one embodiment, data collection server 104 receives the location data and movement data of the remote devices 110 and stores the data in a database 104*a*. The software resident on the data collection server 104 processes the collected data stored in the database 104*a* to generate a map of an area or refine a map already built and stored in database 104*a*, including refining the stored map to include any key points, zones, or regions within the area, such as entrances doorways, patient rooms, the particular floor being mapped in a multi-floor building, corridors or hallways, central monitoring stations, therapy rooms, and any other such characterizations that may be useful when included on a map. In one particular embodiment, data collection server 104 is configured to receive location data and movement data of multiple remote devices 110 and process the location data of the multiple remote devices 110 to generate a map of an area and store the map in the database 104*a*.

Figure 2:
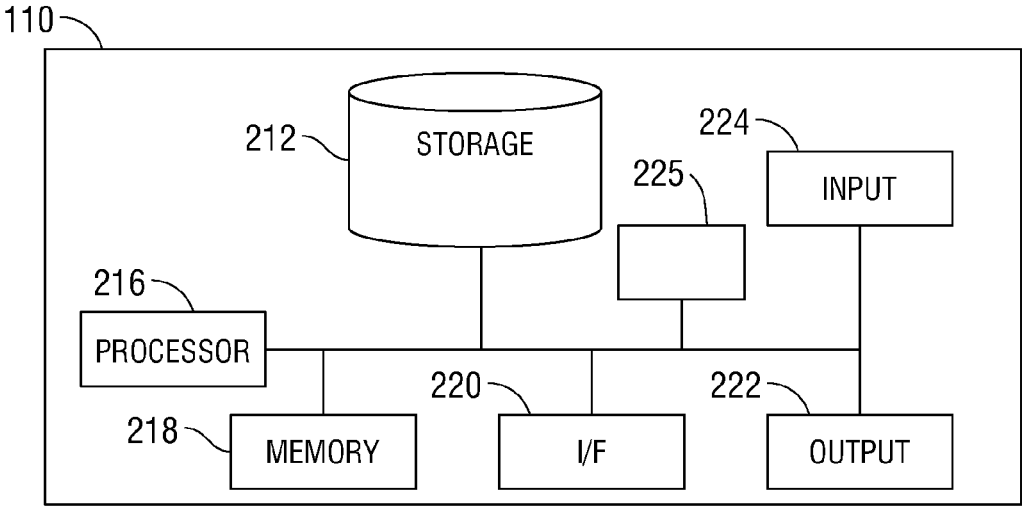
FIG. 2 is a schematic illustration of an example remote device of the system in FIG. 1, according to certain embodiments of the present disclosure.

FIG. 2 illustrates a detailed view of an example remote device 110 of system 100, according to certain embodiments of the present disclosure. Remote devices 110 may be any device that provides output to, and can receive input from, a user, such as a clinician and capable of determining geographic position data, or location data of the remote device 110. In certain embodiments, output at remote devices 110 includes vibrations, display views including pop-up messages, sound, or any combination desired. Each remote device 110 includes input components (such as a keypad, touch screen, mouse, or other device that can accept input), output devices, mass storage media, or other suitable components for receiving, processing, storing, and communicating data.

According to one embodiment, remote devices 110 display one or more web pages in the form of GUI's (FIGS. 10-12), which may be hosted by data collection server 104, and display map building software, maps, routes between points in a map, and patient data. The remote device 110 also receives data from any of the components of system 100, and transmits data to any of the components of system 100.

Remote device 110 includes a processor 216, a memory 218, a communication interface (I/F) 220, an output device 222, an input device 224, and a location data generator 225, which are described in further detail below. Although this particular implementation of remote device 110 is illustrated and primarily described, the present disclosure contemplates any suitable implementation of remote device 110 according to particular needs.

Continuing with reference to FIG. 2, storage device 212 is similar to database 104*a* and may include any suitable device operable for storing data and instructions. Storage device 212 includes, for example, Random Access Memory (RAM) or Read Only Memory (ROM), EEPROM, a magnetic disk, flash memory, optical disk, or other suitable data storage device.

Memory 218 and/or storage 212 may include software or instructions that when executed by the processor 216 cause the processor 216 to calculate the location of the mobile device 110. Examples of the instructions may include a thick client such as a native application that runs on the remote device 110 and which receives data from the data collection server 104 and conducts its own processing and data manipulation. Alternatively, the instructions may be a thin client interface enabling display of data received from data collection server 104, and all processing and data manipulation occurs at the data collection server 104 and is made available via a browser such as Mozilla (Firefox), Internet Explorer, Google Chrome, Safari or any other current or future browsers.

Processor 216 includes any suitable device operable to execute instructions and manipulate data to perform operations. Processor 216 may include, for example, any type of central processing unit (CPU). Memory 218 includes any computer memory (for example, Random Access Memory (RAM) or Read Only Memory (ROM)), mass storage media (for example, a hard disk), removable storage media (for example, a Compact Disk (CD), a Digital Video Disk (DVD), or USB Flash Drive), database and/or network storage (for example, a server). Memory 218 may comprise any other computer-readable tangible medium, or a combination of any of the preceding.

I/F 220 includes any suitable device operable to receive input, send output, perform suitable processing of the input or output or both, communicate to other devices, such as other remote devices 110, location unit 107, and/or data collection server 104, or any combination of the preceding. I/F 220 may include appropriate hardware (for example, a modem, network interface card, etc.) and software, including protocol conversion and data processing capabilities, to communicate through a LAN, WAN, or other communication system that allows remote device 110 to communicate to other devices.

Figure 10:
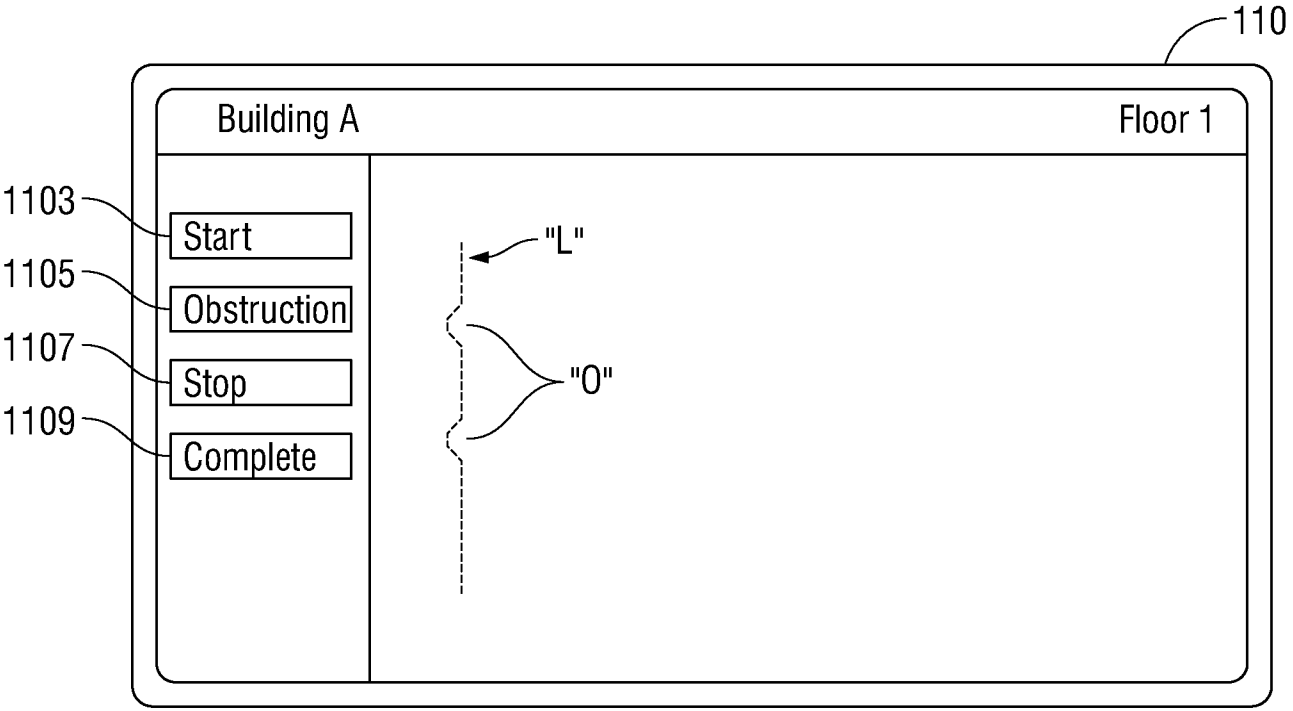
FIG. 10 is an example graphical user interface of a remote device, according to certain embodiments of the present disclosure.
Figure 11:
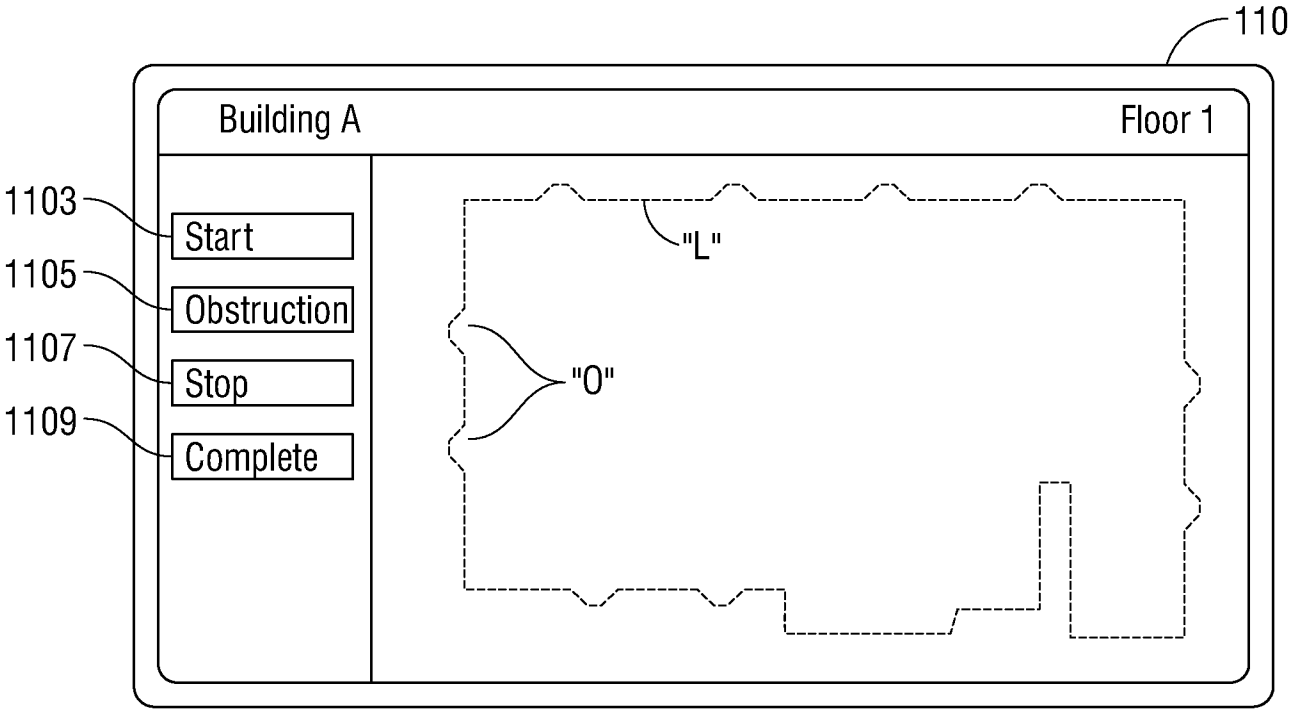
FIG. 11 is an example graphical user interface of a remote device, according to certain embodiments of the present disclosure.
Figure 12:
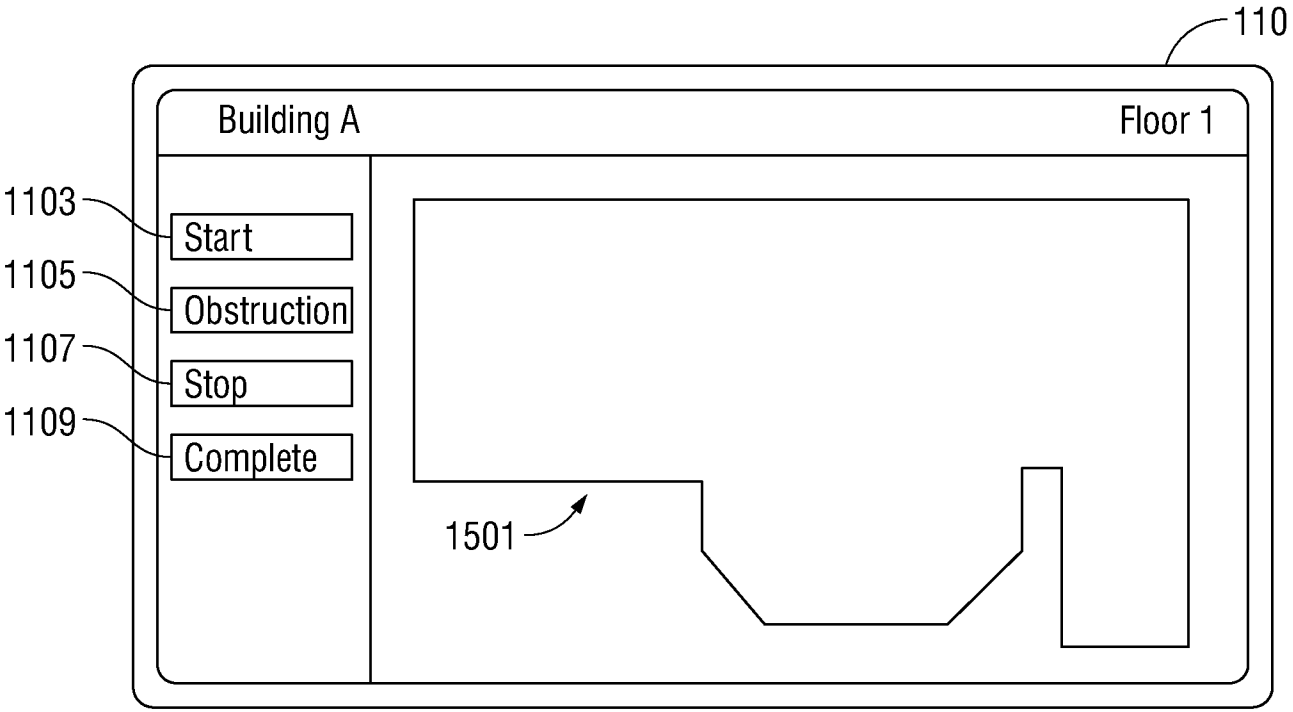
FIG. 12 is an example graphical user interface of a remote device, according to certain embodiments of the present disclosure.

Output device 222 includes any suitable device operable for displaying information to a user, for example in the form of a GUI (FIGS. 10-12). Output device 222 may include, for example, a touch screen, a video display, a printer, a plotter, or other suitable output device. Input device 224 includes any suitable device operable to input, select, and/or manipulate various data and information. Input device 224 may include, for example, a touch screen, a keyboard, mouse, graphics tablet, joystick, light pen, microphone, scanner, or other suitable input device.

Location data generator 225 includes any suitable device for receiving signals from location unit 107 (FIG. 1) and generating location data of the mobile device 110 for map building or transmission to data collection server 104 (FIG. 1). For example, in certain embodiments, location data generator 225 is a GPS receiver which communicates with location units(s) 107 to generate geographical location data of the mobile device 110. In some embodiments, multiple location units 107 are in communication with mobile devices 110, via location data generator 225, and the location data of the mobile device 110 is calculated using triangulation techniques and other methods known in the art.

In some embodiments, location data generator 225 may utilize additional components such as pods or other components attached to a body part or clothing of users such as clinicians and patients. For example, location data generator 225 may utilize pods attached to a users shoe for calculating positions of the users based on the movement of the pods attached to the users.

Modifications, additions, or omissions may be made to remote device 110 without departing from the scope of the disclosure. The components of remote device 110 may be integrated or separated. Moreover, the operations of remote device 110 may be performed by more, fewer, or other components. Additionally, in some embodiments, remote devices 110 are configured to transmit data to the data collection server 104, and the data collection server 104 includes a processing unit or processor and memory storing instructions that cause the processor to carry out any or all of the functions and/or methods described with respect to the processes carried out by the mobile devices 110.

Figure 3:
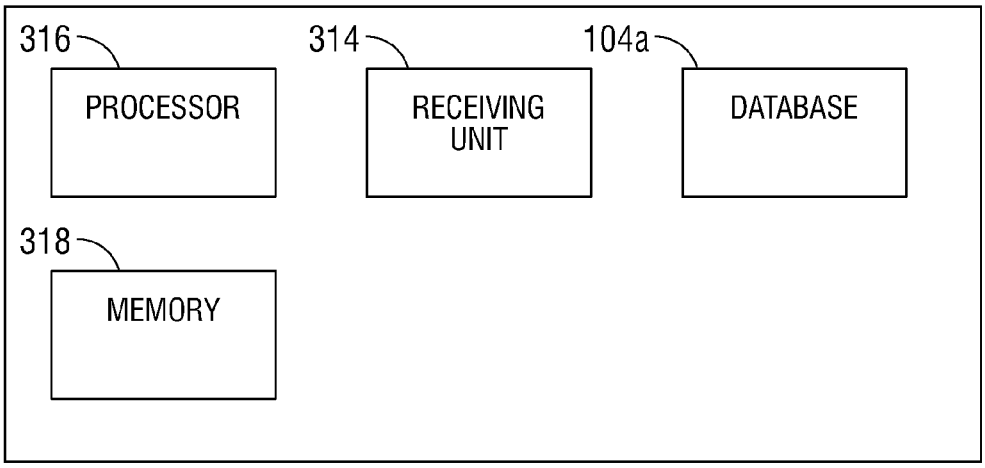
FIG. 3 is a schematic illustration of an example data collection server of the system of FIG. 1, according to certain embodiments of the present disclosure.

In particular, and turning now to FIG. 3, shown is a detailed view of an example data collection server 104 of system 100, according to certain embodiments of the present disclosure. Data collection server includes a receiving unit 314, processor 316, memory 318, and database 104*a*. The processor 316 and memory 318 of data collection server 104 are similar to the processor 216 and memory 218 of remote device 110 (FIG. 2) and therefore will not be further described.

Receiving unit 314 may include any suitable device for receiving data from the mobile devices 110 for storage in database 104*a* and/or processing by the processor 316. In particular, receiving unit 316 receives the location data and movement data of the remote devices 110 for storage in the database 104 to build a map, refine a map already built, and/or carry out any of the methods and processes described below. The data received from remote devices 110 may be pulled by the receiving unit 314 or may be pushed by the remote devices 110. Movement data may be calculated by the location data with reference to a change in time. The movement data may also factor supporting data, e.g., associated timestamps in order to determine movement. In one embodiment, receiving unit 314 receives only location data from the remote devices 110 and calculates the movement data of each respective remote device 110 based on the change in time implied by the data collection server 104. In other embodiments, the remote device 110 maintains a series of (location, time) tuples and sends a collection to the server at a later time.

Database 104*a* stores all of the location and movement data of the remote devices 110 received by receiving unit 314. Additionally, database 104*a* stores maps of areas and any data associated with the maps such as boundaries, characterizations, regions, zones, or key points of the map or area. In some embodiments, database 104*a* stores patient data which may include for example, real-time patient parameters generated by medical devices that are monitoring patients (FIG. 6), patient history, images of patients, images of patient rooms, etc. In additional embodiments, database 104*a* may store images of the mapped area and key point, regions, or zones within the area. For example, database 104*a* may include images of patient rooms, hallways, room numbers, patients positioned within the rooms, images of medical devices, and any other such mapping data.

Turning now to FIGS. 4-8, methods for building a map of an area, refining a map of an area, and monitoring movement of remote devices 110 within a mapped area are illustrated and described. The methods described herein are processes stored in the form of instructions in the memory 218, 318 of remote devices 110 and/or data collection server 104, which when executed by the processor 216, 316, causes the processor 216, 318 to carry out the steps of the methods. It is envisioned that although the methods described herein are illustrated and described as including particular steps and are described as in a particular order, the methods may include some or all of the steps and may be arranged in any order not specifically described.

Figure 4:
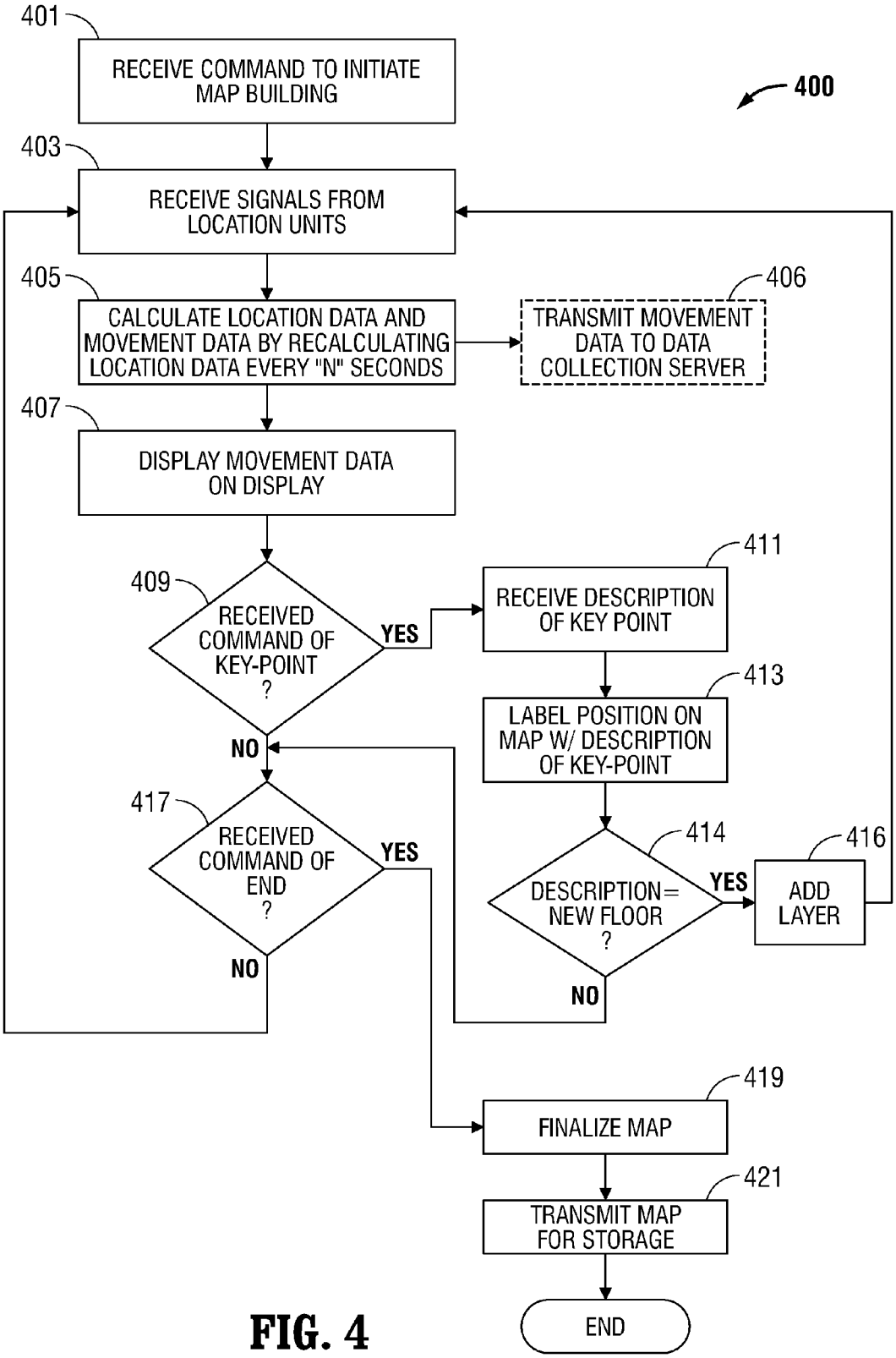
FIG. 4 is a flow chart depicting a method for building a map, or defining a boundary to be used in building a map, using the movement data of a remote device, according an embodiment of the present disclosure.

With particular reference to FIG. 4, a method for building a map is illustrated and described as method 400. In an embodiment, a single user carrying a single remote device 110 would initiate method 400 for the purpose of either building a map of a hospital and its respective floors, and/or defining a perimeter (or boundaries) of an area to be mapped. The perimeter (boundaries) can be stored in database 104*a* and processed by data collection server 104 to further build or refine a map of an area based on the boundaries defined.

Method 400 begins at step 401 where a user initiates the map building process. Initiating the map building process, in step 401, causes the processor 216 in remote device 110 to perform the remaining steps of method 400. In step 403, remote device 110 receives signals from one or more location units 107 which enables remote device 110 to carry out step 405. In step 405, remote device 110 calculates its geographic position (coordinates) as location data. Further, in step 405, the remote device 110 continuously re-calculates its location data every "n" seconds. The change in location may be separately stored as movement data. In one embodiment, the remote device 110 determines its movement data (continuously re-calculates its location data) every five seconds. In some embodiments, as shown in step 406, the remote device 110 transmits the movement data calculated in step 405 to the data collection server 104 for storage in database 104*a* and further processing. It is envisioned that the location data may be transmitted to the data collection server 104 in real-time enabling movement data to be calculated by the data collection server 104, and thus conserve processing resources of the remote device 110. In some embodiments, the location data and/or movement data is calculated every one second, though other periods may be employed without departing from the scope of the present disclosure.

In step 407, the movement data is displayed on the output (display) of the remote device 110 such that a user can see the movement data of the remote device 110 since the process was initiated in step 401 in the form of a GUI (FIGS. 10-12). At this point, in use, a user may travel around a hospital building and optionally within the hospital building, while carrying the remote device 110. While doing so, the user can mark key points on the map. In particular, the user can differentiate between different floors that are being mapped, label zones as patient rooms, therapy rooms, central monitoring stations, corridors or hallways, doorways, stairways, entrances, patient beds, medical equipment any other such labels that the user desires to include in the map. In this regard, in step 409, it is determined whether a key point command has been received. If no command to enter a key point is received (NO in step 409), then method 400 proceeds to step 417. Alternatively, if a command to enter a key point is received (YES in step 409), then in step 411*a* description of the key point is received. In other words, after a user indicates that a key point exists, the user may then input a description of the key point, i.e. the user may indicate that the region is a patient room. This may be manually performed, or may be done using pre-set codes or lists such as found in drop-down menus and the like to allow for faster marking. In step 413, the remote device 100 labels the position on the map with the description of the key point received in step 411.

In step 414, the remote device 110 determines if the description of the key point received in step 411 is a new floor. If the description is a new floor (YES in step 414), then a new layer is added to the map that corresponds to the new floor and method 400 reverts back to step 403, where all newly acquired movement data will be used to build the new layer. Alternatively, if the description is not a new floor (NO in step 414), then remote device 110 determines if a command to end the map building process has been received in step 417. If no command to end the map building process is received (NO in step 417), then method 400 reverts back to step 403, such that remote device 110 continues calculating the movement data and building the map. Alternatively, if a command to end the process is received (YES in step 417), then in step 419 remote device 110 finalizes the map using all of the movement data and key point data received. In the finalization process, the remote device 110 closes all gaps in the movement data and automatically filters out obstructions and issues. The step of finalizing the map in step 419, may also include displaying the finalized map in the form of a GUI (FIGS. 10-12) on the remote device 110, such that a user may approve or alter the finalized map. In this regard, a user can input key points that have been left out during the map building process. In step 421, the map that has been built and finalized in step 419 is delivered to data collection server 104 for storage in the database 104*a* and for further processing.

Figure 5:
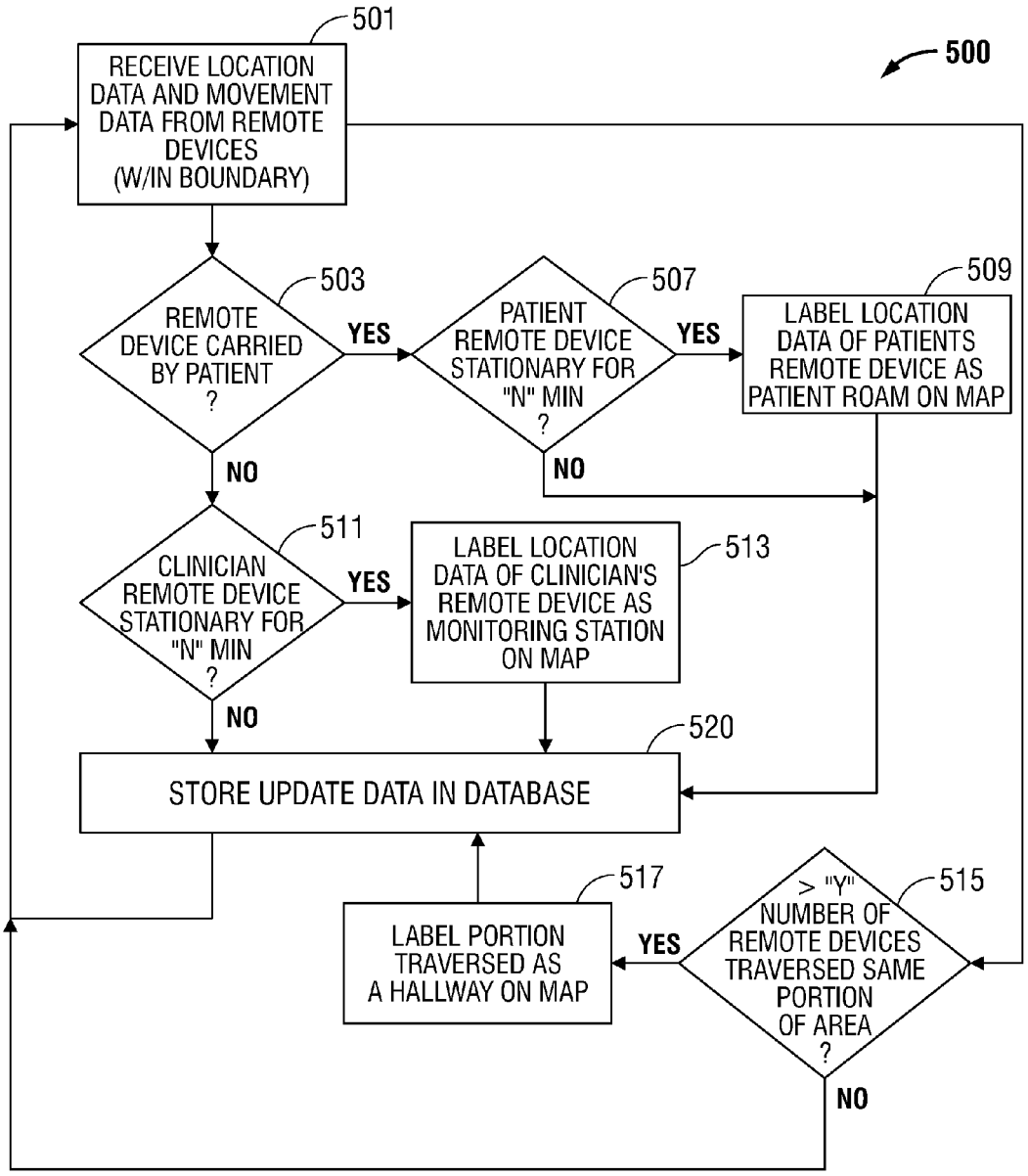
FIG. 5 is a method for refining a map, according to certain embodiments of the present disclosure.

Turning now to FIG. 5, a method for refining a map stored in database 104*a* is illustrated and described as method 500. As described above, in embodiments, data collection server 104 receives and stores maps that were built (for example, by a remote device 110 using the process described in method 400) or uploaded in database 104*a* for further processing. Method 500 is one example of the further processing where the continuous location and movement data of the remote devices 110 received is used to refine the map stored in database 104. Method 500 is just one example of a refinement process of data collection server 104 and it is envisioned that the data collected by data collection server 104 may be used to refine the maps stored in more ways than those described herein. Additionally, in one embodiment, method 500 is used to complete/continue building a map based on boundaries that were defined by a remote device 110 that has completed method 400.

Beginning with step 501, data collection server 104 receives the location data and movement data of at least one remote device 110. In some embodiments, data collection server 104 only receives the location data and movement data of remote devices 110 that are positioned within a specified boundary which may include remote devices 110 located within the outer edges of a building, or remote devices 110 located on a particular floor. As described above, the boundaries may have been defined by a remote device 110 processing the steps of method 400.

In step 503, data collection server 104 determines if the location data and movement data received is coming from a remote device 110 that is being carried by a patient. In certain embodiments, remote devices 110 are identifiable between each other, for example each remote device may have its own unique serial identification number. In this regard, the unique serial identification number is assigned to either a particular patient or particular clinician. If the remote device 110 is monitoring the movement of a patient (YES in step 503), then data collection server 104 determines if the remote device 110 has been stationary for longer than a predetermined period of time. The term predetermined, as used herein, includes any value that may be configurable. In embodiments, a remote device 110 is considered to be stationary when the movement has not exceeded a predetermined distance within a predetermined period of time. The distance may be automatically configured by any component of the system 100 or may be configured by a user of the system 100. In one embodiment, the distance is two feet tough other distances may be used without departing from the scope of the present disclosure. In an embodiment, the predetermined period of time is one hour. If the patient remote device 110 is stationary for longer than the predetermined period of time (YES in step 507), then in step 509, data collection server 104 considers the position of the stationary patient remote device 110 to be a patient room and labels such a characterization as a key point on the map. Then the new label is stored in the database 104*a* in step 520.

Alternatively, if the remote device is not carried by a patient (NO in step 503), then in step 511, data collection server 104 determines if the clinician remote device 110 has been stationary for longer than a predetermined period of time. If the clinician remote device 110 is stationary for longer than the predetermined period of time (YES in step 511), then in step 513, data collection server 104 considers the position of the stationary clinician remote device 110 to be a central monitoring station and labels such a characterization as a key point on the map. The new label is stored in database 104*a* in step 520.

Additionally, in step 515, data collection server 104 determines if the number of remote devices 110 that have traversed the same portion is greater than a predetermined number "y." If less than the predetermined number of remote devices 110 traverse the same portion (NO, in step 515), then data collection server 104 continues receiving the location data and movement data of the remote devices 110 (method 500 reverts back to step 501). Alternatively, if the number of remote devices 110 that traverse a particular portion is greater than "y" (YES, in step 515), then data collection server 104 labels that portion as a hallway on the map in step 517 and method 500 proceeds to step 520 where the updated map data with the labels are stored in the database 104*a*.

Although not illustrated, data collection server 104 may make other characterizations. For example, data collection server 104 may associate one or more patient rooms with a central monitoring station after each as been labeled in steps 509, and 513, respectively, based on the location and/or distance of each patient room with the central monitoring station. Further, data collection server 104 may label regions on a map based on adjacent labels. For example, data collection server 104 may label an area between a hallway and a patient room (or any other room) as a doorway based on instructions that dictate that a room and a hallway must be separate by a doorway. Additionally, although method 500 has been described as a method for refining a previously built map stored in database 104*a*, it is envisioned that the steps of method 500 may also be used to build a map using the location data and movement data of multiple remote devices 110.

Additionally, labels and characterizations made by remote devices 110 and/or data collection server 104 may be reviewed, subsequently altered, or edited by users or automatically by any component of the system 100. For example, in particular embodiments a user can change the label of a room from a washroom to a patient room. Additionally, the map stored may be constantly updated with new information relating to any changes in the environment such as and without limitation obstructions, broken elevators, closed corridors, closed rooms, private areas, etc. In a particular embodiment, system 100 uses an exponential moving average technique to perform the constant dynamic updating of the maps stored in database 104*a* based on the newly acquired location and movement data received from remote devices 110. In this regard, the newly acquired location data and movement data is given more weight than the older data for the purposes of updating or refining the maps stored.

Figure 6:
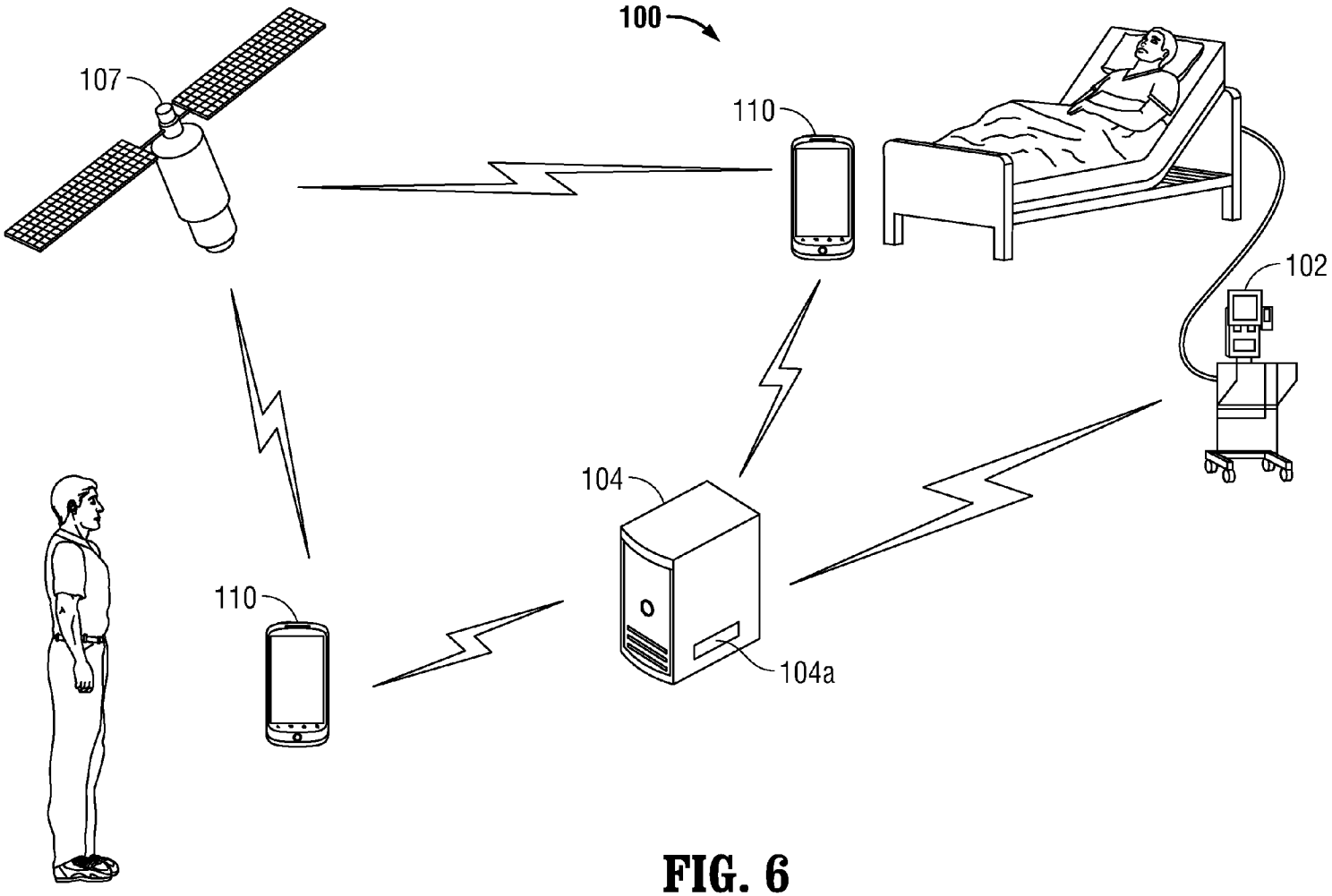
FIG. 6 illustrates an example monitoring system using location and movement data, according to certain embodiments of the present disclosure.

Turning now to FIG. 6, system 100 is shown as including a data collection server 104, a location unit 107, a remote device 110 associated with a clinician, a remote device 110 associated with a patient, and a medical device 102 monitoring the patient. Medical devices 102 may be any devices that are used for monitoring, tracking or treating patients. Medical devices 102 generate patient data or patient parameters. For example, medical devices 102 may include a ventilator connected to a patient to deliver respiration therapy, a pulse oximeter that monitors the oxygen saturation of a patient's blood, a device for tracking a patient within a hospital with or without monitoring a physiological condition, as well as other medical devices known to those of skill in the art. Medical devices 102 are communicatively coupled to data collection server 104 and/or remote device 110, such that data collection server 104 can receive, store, and process the patient parameters generated by the medical devices 102. Medical devices 102 and/or data collection server 104 process the patient parameters and determine if the patient parameters are at levels that exceed safe thresholds. If the patient parameters exceed safe thresholds, then an alarming condition notification can be triggered. The alarming condition notification may also include conditions that are not alarming but are simply for alerting, calling, or otherwise notifying. In this regard, although described herein as an alarming condition notification, it is understood that the alarming condition notification may also be triggered for non-alarming conditions.

Figure 7:
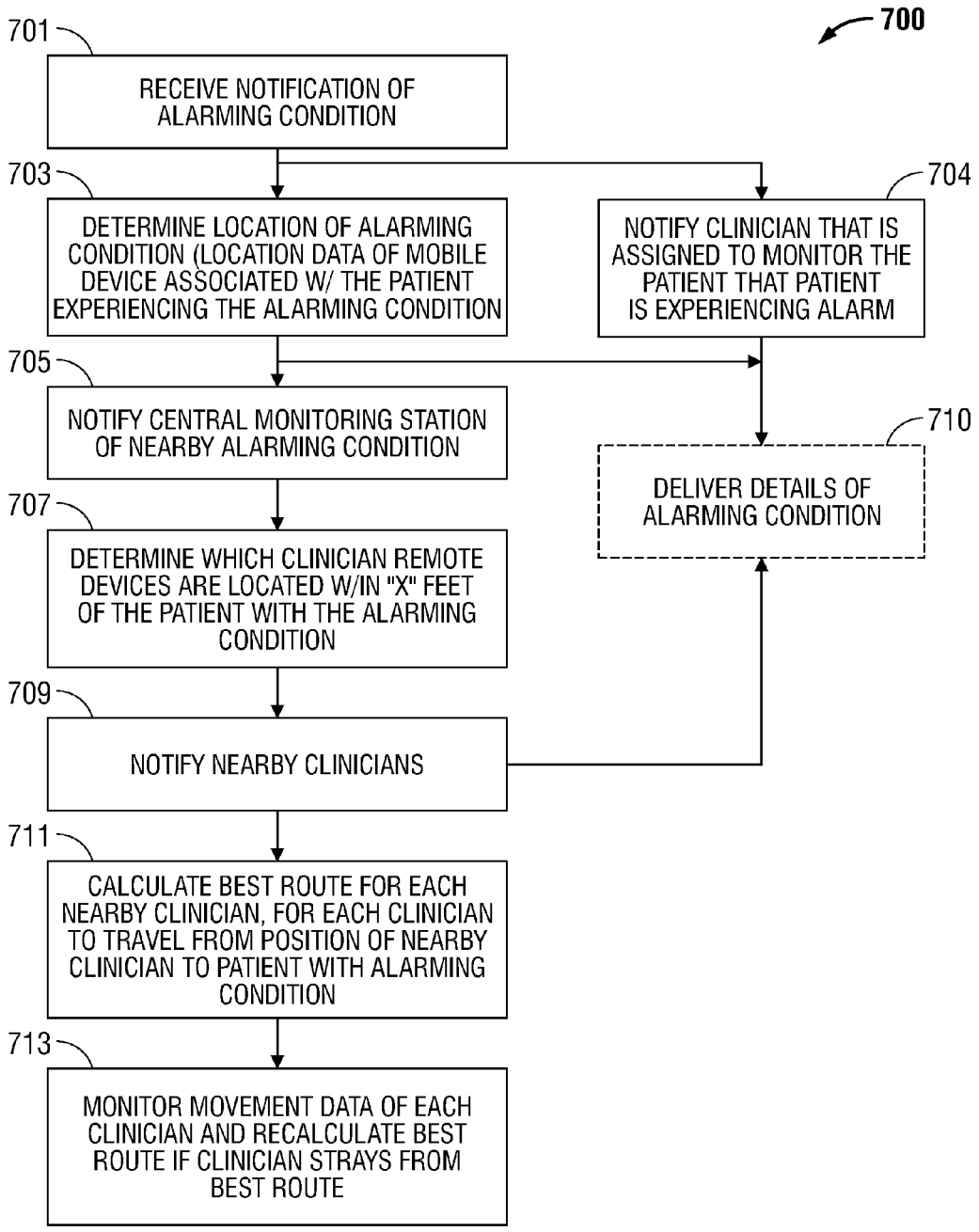
FIG. 7 is an example flow chart depicting a method for notifying at least one remote device of an alarming condition, according to certain embodiments of the present disclosure.
Figure 8:
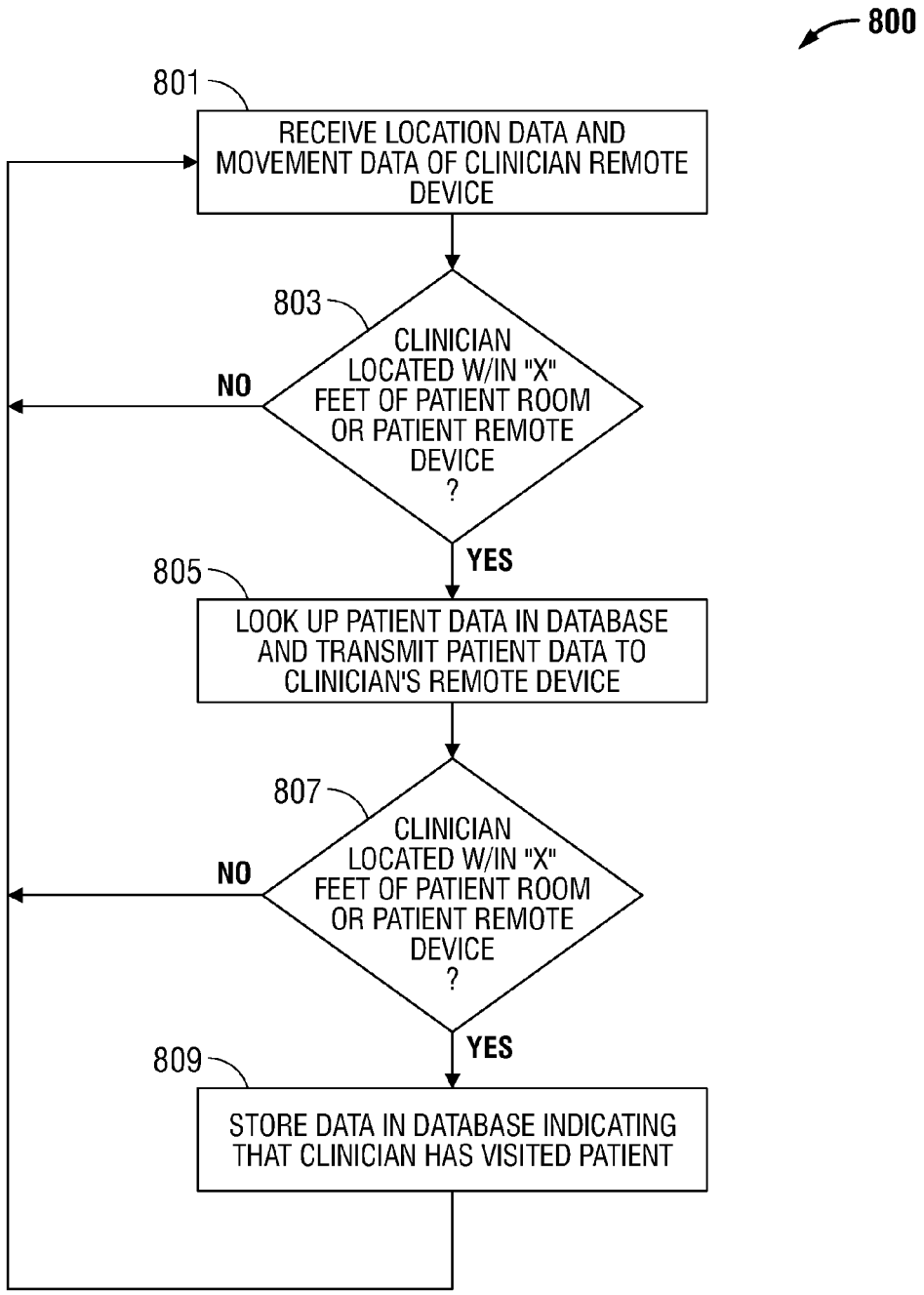
FIG. 8 is a flow chart depicting a method for managing clinicians and continuously pushing patient data of nearby patients to clinician remote devices, according to another embodiment of the present disclosure.
Figure 9:
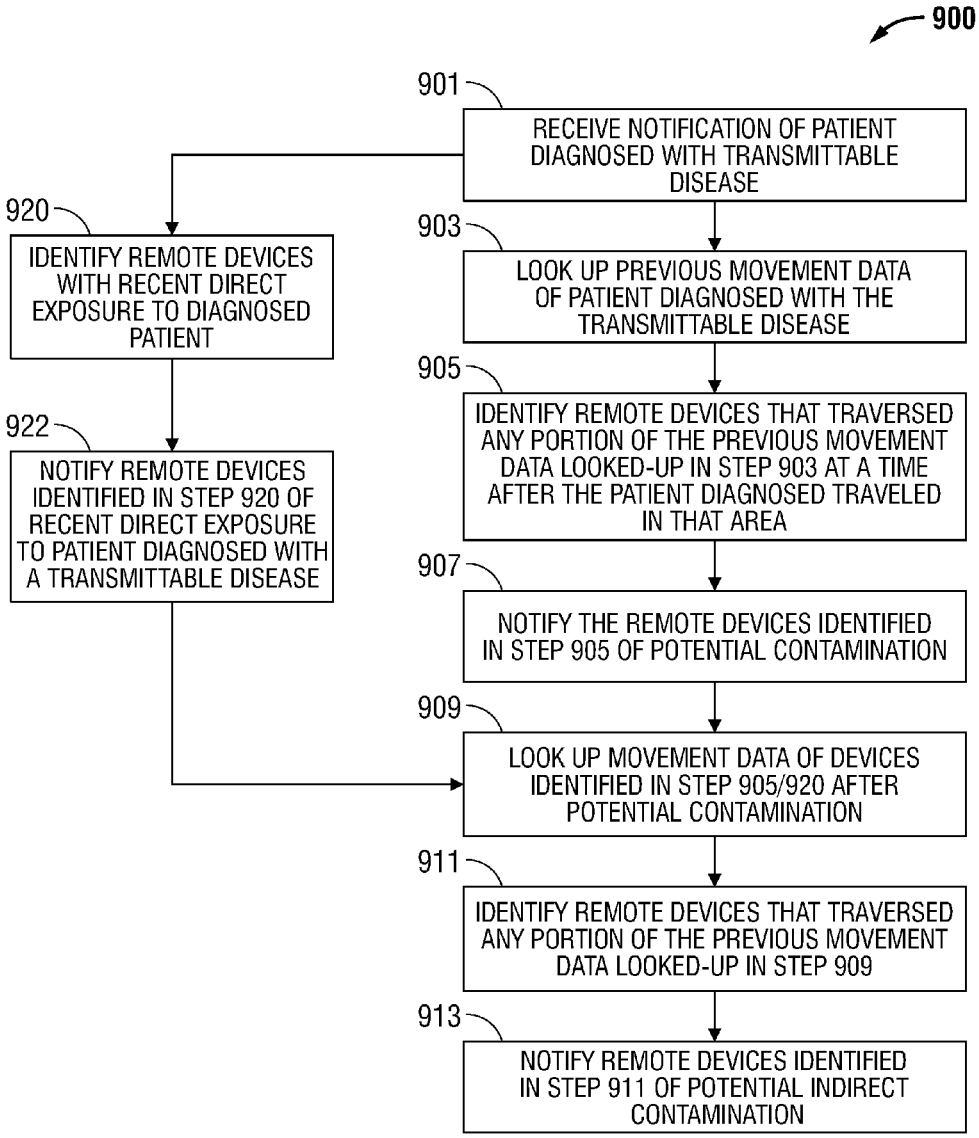
FIG. 9 is an example flow chart depicting a method for minimizing the spread of transmittable diseases within an area, in accordance with certain embodiments of the present disclosure.

Turning now to FIGS. 7-9, methods for using the location data received from clinician remote devices 110 and patient remote devices 110 will be described. With particular reference to FIG. 7, a method for notifying the nearest clinician of an alarming patient condition is shown and described as method 700. Although described herein as a method for notifying the nearest clinician, method 700 may also be used to notify multiple clinicians and/or optimal clinicians which may or may not be near the alarming condition. Method 700 begins with step 701, where data collection server 104 receives a notification of an alarming condition. An alarming condition may include any type of alarming condition that is detected by medical devices 102. In particular, when medical devices 102 detect that any patient parameters have exceeded predetermined safe threshold levels, the medical devices 102 notify the data collection server 104 of an alarming condition. The data collection server 104 may then broadcast a notification automatically to a clinician or clinicians it determines to be best able to handle the alarming condition. This may be based on specialty, identification as the on-call physician, proximity to the patient, floor location of the patient and the clinician, zones, or a combination of these and other factors. For example, system 100 may be capable of ruling out particular clinicians because the alarming condition is not related to their area of expertise or specialty, even though those clinicians are nearest to the alarming conditions. Alternatively, in some embodiments, where some alarming conditions require immediate attention, no clinician will be ruled out based on their specialty because the alarming condition requires immediate attention. In addition, according to further embodiments a user such as patients or nurses may initiate or trigger a notification of an alarming condition, or a notification of a non-alarming condition, to alert the nearest, or optimal, clinician or clinicians of a patient in need of assistance.

In step 703, data collection server 104 determines the location of the alarming condition, i.e. the location of the patient experiencing the alarming condition or location of where the notification was triggered. In particular, the data collection server 104 searches the database 104*a* for information relating to the patient room that the patient experiencing the alarming condition has been assigned, and may cross reference this data with location data of the patient based on the determined location of the patient's remote device 110. Alternatively, in an embodiment, the remote device 110 associated with the patient with the alarming condition may receive a notification from the medical device 102 monitoring the patient, or otherwise detects, that the patient is experiencing an alarming condition. The remote device 110 itself may deliver the notification to the data collection server 104 indicating the location data of the patient with the alarming condition. This may be beneficial where the medical device is a non-networked device that cannot communicate directly with the data collection server 104

In step 704, data collection server 104 delivers a notification to the remote device 110 of the clinician that is responsible for overseeing the patient that has been identified as experiencing the alarming condition (regardless of the position or location data of the responsible clinician). In step 705, data collection server 104 notifies the central monitoring station, for example the remote devices 110 of the clinicians located in the central monitoring station, that oversees the patient room where the patient that is experiencing the alarming condition is located.

In step 707, data collection server 104 determines which clinician remote devices 110 are located within "x" feet of the patient experiencing the alarming condition. In one embodiment, all clinician remote devices 110 that are positioned within 100 feet and within the same floor in a multi-floor building of the patient experiencing the alarming condition are considered to be nearby clinicians. In another embodiment, the data collection server 104 determines which clinician mobile devices 110 are closest in distance and/or estimated travel time to the patient experiencing the alarming condition. In step 709, the nearby clinicians are notified of the nearby alarming condition or alerting condition. In particular, the data collection server 104 transmits a notification to the nearby remote devices 110 indicating that a nearby patient is experiencing an alarming condition.

In embodiments, the clinicians and individuals determined in steps 704, 705, 707, and 709, may also be selected, or not selected, by data collection server 104 based on their specialty, location, and/or data corresponding to their activity at the time of the trigger or alarming condition notification. For example, system 100 may determine to avoid notifying a clinician that is performing a surgical procedure at the time of the alarming condition, even though that particular clinician is located within the configured distance threshold (within "x" feet) of step 707. Further, although some clinicians would normally not be considered by system 100 because the alarming condition is not related to their specialty, the severity of the alarming condition may play a role in determining whether to notify those particular clinicians. For example, if an alarming condition is a condition that requires immediate medical attention, all nearby clinicians (located within "x" feet) will be notified, without regard to the specialty of the clinician or what activity the clinician is carrying out at the time of the alarming condition notification.

In step 710, data collection server 104 delivers details of the alarming condition to the remote devices identified in any of steps 704, 705, 707 and 709. The details can include, for example, the cause of the alarming condition, patient parameters, threshold levels, patient history, patient identity, images and/or video of the patient (previously acquired or real-time images and/or video), images of the room where the patient is located, the clinician or clinicians that were alerted or that were attempted to be notified, and any other such details that could assist a clinician in assessing the alarming condition.

In addition to merely notifying the clinician remote devices 110 identified in any of steps 704, 705, 707, and 709, in step 711, data collection server 104 calculates the best-route from the respective clinician locations to the patient's location. The best-route may include the route that includes the shortest travel distance between points or the route that includes the shortest travel time between points. In an embodiment, the data collection server 104 presents both options to the user for selection. In alternative embodiments, the data collection server 104 transmits the best-route as the route including the shortest time of travel from the clinician to the patient. In step 711, the best-route is delivered to the remote device(s) 110 of each of the respective clinicians. In embodiments, step 711 also includes delivering images of the destination to the clinician remote device 110, such that the clinician may visualize the destination and visually confirm their arrival. In one embodiment, routes are calculated using the movement and location data stored in database 104*a*. The movement data of all remote devices 110 are stored in database 104*a* and data collection server 104 processes the movement data tracked to label particular movements as a route between points.

In some embodiments, multiple routes are calculated and delivered to the clinicians. The clinicians may select the route that they desire to use. Additionally, clinicians may be able to modify the routes provided. For example, if a clinician chooses to make a stop prior to arriving at the destination, the clinician can select to modify the route. In this regard, if a clinician needs particular equipment to aid in the alarming condition, the clinician can acquire the equipment prior to attending to the alarming condition. Additionally, if the clinician is aware of an obstruction along the route that has been provided, where the obstruction has not been updated into the map prior to determining the route, the clinician may manually modify the route to avoid the obstruction. Data collection server 104 may even acquire data of the manual route modifications in updating or refining the maps stored and/or modifying existing routes or creating new routes between points. For example, if a particular route has been modified my multiple clinicians on multiple occasions, data collection server 104 may modify that route and submit the modified route to the clinicians in the future.

In step 713, data collection server 104 continues to monitor the movement of the clinicians, via the location and movement data transmitted by their respective remote devices 110 and determines if any of the remote devices 110 is travelling off of the route submitted to the remote device 110. In embodiments, data collection server 104 determines that a clinician is off-route when the clinician remote device 110 has not moved. If the remote device 110 is off the route, then the new position of the clinician is used to calculate the best-route from the clinician to the patient experiencing the alarming condition. Further, the data collection server 104 can determine that the clinician is off the route when the clinician is not moving in a direction to assist the patient and can search for and identify additional clinicians to be notified such that they can respond in place of the clinician that is not moving in the correct direction. Alternatively, in one embodiment, if the clinician has not strayed from the route, then the data collection server 104 receives a notification that the clinician mobile device 110 has arrived to the location of the patient experiencing the alarming condition when the location data of the clinician remote device 110 is within a predetermined threshold, e.g. five feet, of the patient remote device 110.

Additionally, a clinician may transmit a notification to the data collection server 104 indicating that the clinician will not attend the alarming condition. In this regard, if a clinician is currently visiting a patient and cannot respond to the alarming condition, the clinician can notify the data collection server 104 that the clinician will not respond to the alarming condition. Additionally, there may be situations where a clinician is unable to transmit a notification to the data collection server 104, for example, when the clinician is occupied. In such cases, data collection server 104 detects the lack of movement of the clinician, or lack of movement beyond a configurable distance, and determines that the clinician chooses not to respond to the alarming notification. In such cases as the two described above and other similar scenarios, data collection server 104 may transmit notifications to alternative clinicians in place of the clinicians that will not attend to the alarming condition.

Turning now to FIG. 8, a method for managing clinicians in a hospital and continuously pushing relevant patient data to a clinician's remote device 110 based on the location of the clinician is illustrated and described as method 800. Method 800 begins at step 801 where data collection server 104 receives location data and movement data of a remote device 110 associated with a clinician.

In step 803, data collection server 104 determines if the clinician's remote device 110 is located within a predetermined range ("x" feet) of a remote device 110 associated with a patient or within a predetermined range ("x" feet) of a patient room. In one embodiment, data collection server 104 compares the location data of the clinician's remote device 110 to the location data of the patient remote devices 110 transmitting location and movement data to the data collection server 104. If the distance between the clinicians and patients are closer than a predefined threshold, then the patients and clinicians are considered to be nearby. If the clinician's remote device 110 is not located within the predetermined threshold of any patient rooms or patient remote devices 110 (NO in step 803), then method 800 reverts back to step 801.

If the clinician's remote device 110 is located within the predetermined threshold (YES in step 803), then in step 805 data collection server 104 looks up the patient data, and other data that is associated with the region, that is stored in the database 104*a* of the patient that is considered to be nearby. Further, in step 805, data collection server 104 transmits the patient data associated with the nearby patient, and/or the data corresponding to the area where the clinician is positioned, to the clinician's remote device. In this regard, as a clinician is traveling through a hospital, the clinician's remote device 110 is continuously updated with patient data and regional data corresponding to patients that are located within the vicinity of the clinician. The patient data submitted may include any data associated with patient such as identification information stored in the database 104*a* and patient parameters generated by the medical devices 102 that are monitoring the patients. Additionally, the data submitted to the remote device 110 may include images of the patient rooms or any other such images of the area. In this regard, clinicians with infrequent contact to a patient may easily recognize the patient that they need to work with by having the patient data pushed to their remote device 110.

Additionally, in step 807, data collection server 104 determines if the clinician's remote device 110 is located within a second predetermined threshold ("n" feet) of either a patient room or a patient's remote device 110. In an embodiment, the second predetermined threshold is three feet, and if the clinician is located within three feet of the patient (YES in step 807), then data collection server 104 stores data in database 104*a* indicating that the clinician has visited the patient. In one embodiment, the data stored in the database 104*a* includes the duration of time that the clinician has spent with the patient during the visit and previous visits. In embodiments, this data may is used when determining which clinician to notify of an alarming condition.

Turning now to FIG. 9, a method for minimizing the spread of communicable and dangerous diseases within an area is illustrated and described as method 900. In step 901, data collection server 104 receives a notification that a patient is diagnosed with a dangerous communicable disease. In step 901, data collection server 104 searches database 104*a* and identifies the previous movement data of the patient diagnosed with the dangerous communicable disease. This can be for example, from the emergency room, through admittance, to a floor in the hospital, etc. In one embodiment, the previous movement data considered may be limited by a particular time-frame and/or distance relevant to and defined by the type of disease. In embodiments, when a notification is received in step 901, system 100 may also be configured to manipulate a ventilation system in the facility, such that ventilation may be activated or deactivated to manipulate the spread of an airborne disease.

In step 905, data collection server 104 identifies remote devices 110 that traversed any portions of the previous movement data looked-up in step 903 after the patient diagnosed travelled in that area, within for example a certain time frame. This roughly correlates to individuals who might have come in contact with the patient, or who might have been exposed to the patient or the disease. In step 907, the remote devices 110 identified in step 905 are notified of a potential contamination based on exposure to the path travelled by a patient diagnosed with a transmittable disease.

In step 909, data collection server 104 looks up the movement data of the remote devices 110 identified in step 905 corresponding to any movement that occurred after the initial exposure. In step 911, data collection server 104 identifies any remote devices 110 that traversed any portion of the previous movement data looked-up in step 909. In step 913, the remote devices 110 that were identified in step 911 are notified of a potential indirect contamination. This step is optional as already the exposure is potentially attenuated, particularly where the vector of transmission is identified by a remote device that merely traversed a small segment of the diagnosed patient's path, or who's exposure occurred some time after the movement of the diagnosed patient.

In addition to notifying the remote devices 110 identified in steps 905 and 911, data collection server 104 may also notify the clinicians associated with or who were otherwise exposed to the diagnosed patient that their other patients have been potentially exposed to another patient that has been diagnosed with a dangerous communicable disease.

Additionally, in step 920, data collection server 104 identifies all remote devices 110 that were in recent direct contact/exposure to the patient diagnosed with the transmittable disease. In step 922, the remote devices identified in step 920 are notified of their direct exposure. After identifying the remote devices 110 in step 920 and/or notifying the remote devices 110 in step 922, method 900 proceeds to step 909 which has been described above.

Additional embodiments are also contemplated for the use of the location and movement data. For example, the data collection server 104 may calculate patient data by monitoring the patient movement, activity, and location data received. A conclusion can be made by data collection server 104 based on this data received. For example, data collection server 104 may update the patient parameters or patient data to include information that a patient has attended a physical therapy session for one hour when the data collection server 104 receives location and movement data of the patient remote device 110 indicating that the patient has moved from the patient room to the physical therapy room, remained in the physical therapy room for one hour, and moved back to the patient room. The data indicating that the patient has attended the physical therapy session may then be stored as patient data in the database 104*a*.

Additionally, the location data, movement data, and activity data may be used by data collection server 104 to identify the source of a disease within the mapped area. For example, data collection server 104 can cross-reference each of the patients that have been newly diagnosed with a particular disease and back-track their respective history of movement. Using the history of movement, data collection server 104 can pinpoint, or otherwise identify, the potential origin of the disease, or areas within the hospital that may be infected, or otherwise contaminated. With this data available, data collection server 104 may notify the remote devices 110 of areas that may be potentially infected and warn the users not to travel within that region. In some embodiments, data collections server 104 generates a report which may be delivered to remote devices 110 of clinicians or a system administrator which includes data associated with the diagnosis and potential contamination. In this regard, the path of the diagnosed patient may be sterilized.

Turning now to FIGS. 10-12, a display of a remote device 110 is shown with GUIs which are used for building a map of an area and creating routes between geographical points. With particular reference to FIG. 10, a remote device 110 is shown with a GUI for mapping an area (or defining a boundary of an area) at an initial stage with several icons on the GUI. The term icon, as used herein, is understood to include any type of button, graphical button displayed on a screen, hardkey, soft-key, drop-down, indicator, and/or any other type of selection mechanism appreciated in the art. To begin the mapping or route creation, a user would select the start icon 1103 on the GUI. In an embodiment, the data collection server 104 would prompt the user to select between creating a map for an area, a route between points, or defining a border/boundary for an area to be mapped. Selecting the start icon 1103 initiates the calculation of the location data from the remote device 110 using the signal(s) received from the location unit(s) 107 and initiates the process of method 400 (FIG. 4).

Continuing with reference to FIG. 10, in use, a user proceeds to map the area by moving the remote device 110 (e.g., walking with the device while calculating position data). In FIG. 10, the movement of the remote device 110 is shown by the line "L." In one embodiment, a user would move the remote device 110 alongside the exterior and/or interior of the hospital building for the data collection server 104 to create a border for the mapped region. While moving the remote device 110, the user may indicate any obstructions that are present by selecting the obstruction icon 1105. Additionally shown in FIG. 10 is a stop icon 1107 and a complete icon 1109. A user can pause the mapping process by selecting the stop icon 1107 and complete the map by selecting the complete icon 1109.

Turning now to FIG. 11, a GUI is shown on remote device 100 after a user has completed mapping the entire area, creating a route, or defining boundaries. The movements of the remote device 110 are displayed on the GUI as lines "L." Subsequent to completing the mapping, the user selects the complete icon 1109, which prompts the finalization process (FIG. 5). Obstructions "0" indicate areas where a user has selected the obstruction icon 1105. In an embodiment, data collection server 104 and/or remote device 110 is configured to detect obstructions automatically, based on the movements of the remote device 110 and/or patterns recognized by data collection server 104 or remote device 110. For example, if a line "L" seems to be substantially straight, and goes off-course for only a short period of time, data collection server 104 or remote device 110 can detect an obstruction without a user selecting the obstruction icon 405.

Turning now to FIG. 12, and continuing with reference to FIGS. 10-11, illustrated is a GUI showing a finalized map 1501 after a user has completed the mapping process of method 400. The finalized map 1501 is displayed after a user selects the complete icon 1109. As shown in the finalized map 1501, all of the obstructions "0" have been taken into account during the mapping process. In particular, all areas marked as obstructions "0" have been altered to show a straight line.

FIGS. 10-12 are illustrated and described as example GUIs that may be included in system 100 for mapping, i.e., building a map, building a route between points, and/or defining a boundary of an area to be map. In embodiments, the processes described with respect to the GUIs illustrated in FIGS. 10-12 are also used to map hallways, corridors, rooms, floors, and any other zones of regions of an area. Further, although described as being used for mapping an area, in embodiments, similar GUIs are used for tracking movements of users for other purposes, such as and without limitation, refining finalized maps, and creating routes to be stored in database 104*a*.

Certain embodiments of the present disclosure comprise logic for receiving map data of an area, building a map using location data, and using location data to monitor patients, and may be embodied in at least one tangible, computer-readable medium. For example, when the logic is executed, it may be operable to receive location data and/or movement data of one or more mobile devices and build or refine a map of an area using the location data and movement data received.

In certain embodiments, the logic for building a map for an area and monitoring patients using location data may be embodied in more than one tangible, computer-readable medium. For example, portions of the logic may be embodied in one or more of medical device 102, data collection server 104, and remote device 110 of system 100 in any manner.

Although the present disclosure describes certain embodiments, various alterations and permutations of the embodiments will be apparent to those skilled in the art. Accordingly, the above description of the embodiments does not constrain this disclosure. Other changes, substitutions, and alterations are possible without departing from the spirit and scope of this disclosure, as defined by the following claims.

What is claimed is:

1. A method for location-based healthcare facility management, comprising:

receiving ongoing location data of a remote device positioned within a healthcare facility;

generating a map of the healthcare facility based on the received ongoing location data of the remote device positioned within the healthcare facility;

receiving ongoing patient data associated with at least one patient being monitored in the healthcare facility; and delivering a notification to the remote device based on the location data of the remote device at a particular time within the map of the healthcare facility generated based on the received ongoing location data of the remote device positioned within the healthcare facility.

2. The method according to claim 1, wherein the generating step includes determining whether the location data of the remote device has changed over a predetermined period of time, and when the location data of the remote device has not changed over the predetermined period of time, labeling the location data of the remote device as a room.

3. The method according to claim 1, further comprising:

receiving ongoing location data of a second remote device; and refining the map of the healthcare facility based on the ongoing location data of the remote device and the second remote device.

4. The method according to claim 1, wherein the healthcare facility includes at least one patient room and the notification is delivered to the remote device when the remote device is located within a predetermined range of the patient room.

5. The method according to claim 1, further comprising:

receiving a notification that a patient is diagnosed with a transmittable disease;

determining previous movement data of the diagnosed patient in a database that includes movement data of a plurality of remote devices;

identifying other remote devices that have traversed at least a portion of the previous movement data determined based on movement data of the other remote devices stored in the database; and notifying the remote devices identified of potential contamination.

6. The method according to claim 1, further comprising receiving an alarm notification indicating an alarming condition of a patient located in the healthcare facility, and wherein the notification delivered includes an alarming notification of a patient.

7. The method according to claim 6, further comprising calculating a best route of an optimal remote device to the location of the alarming condition and notifying the optimal remote device of the best route calculated.

8. A system for location-based healthcare facility management, comprising:

a processor; and a memory storing instructions executable by the processor, wherein the instructions when executed by the processor cause the system to:

receive ongoing location data of a remote device positioned within a healthcare facility;

generate a map of the healthcare facility based on the received ongoing location data of the remote device positioned within the healthcare facility;

receive ongoing patient data associated with at least one patient being monitored in the healthcare facility; and deliver a notification to the remote device based on the location data of the remote device at a particular time within the map of the healthcare facility generated based on the received ongoing location data of the remote device positioned within the healthcare facility.

9. The system according to claim 8, wherein the instructions when executed by the processor further cause the system to determine whether the location data of the remote device has changed over a predetermined period of time, and when the location data of the remote device has not changed over the predetermined period of time, label the location data of the remote device as a room.

10. The system according to claim 8, wherein the instructions when executed by the processor further cause the system to:

receive ongoing location data of a second remote device;

refine the map of the healthcare facility based on the ongoing location data of the remote device and the second remote device.

11. The system according to claim 8, wherein the healthcare facility includes at least one patient room and the notification is delivered to the remote device when the remote device is located within a predetermined range of the patient room.

12. The system according to claim 8, wherein the instructions when executed by the processor further cause the system to:

receive a notification that a patient is diagnosed with a transmittable disease;

determine previous movement data of the diagnosed patient in a database that includes movement data of a plurality of remote devices;

identify other remote devices that have traversed at least a portion of the previous movement data determined based on movement data of the other remote devices stored in the database; and notify the remote devices identified of potential contamination.

13. The system according to claim 8, wherein the instructions when executed by the processor further cause the system to receive an alarm notification indicating an alarming condition of a patient located in the healthcare facility, wherein the notification delivered includes an alarming notification of a patient.

14. The system according to claim 13 wherein the instructions when executed by the processor further cause the system to calculate a best route of an optimal remote device to the location of the alarming condition and notifying the optimal remote device of the best route calculated.

15. A non-transitory computer-readable storage medium storing a program which, when executed by a computer, causes the computer to perform a method for location-based healthcare facility management, the method comprising:

receiving ongoing location data of a remote device positioned within a healthcare facility;

generating a map of the healthcare facility based on the received ongoing location data of the remote device positioned within the healthcare facility;

receiving ongoing patient data associated with at least one patient being monitored in the healthcare facility; and delivering a notification to the remote device based on the location data of the remote device at a particular time within the map of the healthcare facility generated based on the received ongoing location data of the remote device positioned within the healthcare facility.

16. The non-transitory computer-readable storage medium according to claim 15, wherein the generating step includes determining whether the location data of the remote device has changed over a predetermined period of time, and when the location data of the remote device has not changed over the predetermined period of time, labeling the location data of the remote device as a room.

17. The non-transitory computer-readable storage medium according to claim 15, further comprising:

receiving ongoing location data of a second remote device; and refining the map of the healthcare facility based on the ongoing location data of the remote device and the second remote device.

18. The non-transitory computer-readable storage medium according to claim 15, wherein the healthcare facility includes at least one patient room and the notification is delivered to the remote device when the remote device is located within a predetermined range of the patient room.

19. The non-transitory computer-readable storage medium according to claim 15, the method further comprising:

receiving a notification that a patient is diagnosed with a transmittable disease;

determining previous movement data of the diagnosed patient in a database that includes movement data of a plurality of remote devices;

identifying other remote devices that have traversed at least a portion of the previous movement data determined based on the movement data of the other remote devices stored in the database; and notifying the remote devices identified of potential contamination.

20. The non-transitory computer-readable storage medium according to claim 15, the method further comprising receiving an alarm notification indicating an alarming condition of a patient located in the healthcare facility, and wherein the notification delivered includes an alarming notification of a patient.

* * * * *